US008677629B2

(12) United States Patent
Logan

(10) Patent No.: US 8,677,629 B2
(45) Date of Patent: Mar. 25, 2014

(54) SHIELDED KNIFE AND ASSOCIATED METHODS

(76) Inventor: Samuel C. Logan, Sarasota, FL (US)

( * ) Notice: Subject to any disclaimer, the term of this patent is extended or adjusted under 35 U.S.C. 154(b) by 365 days.

(21) Appl. No.: 13/030,391

(22) Filed: Feb. 18, 2011

(65) Prior Publication Data

US 2012/0210584 A1 Aug. 23, 2012

(51) Int. Cl.
*B26B 3/06* (2006.01)

(52) U.S. Cl.
USPC ..... 30/151; 30/162; 30/286

(58) Field of Classification Search
USPC ..... 30/153, 286, 2, 295, 151; 606/167
See application file for complete search history.

(56) References Cited

U.S. PATENT DOCUMENTS

| | | | | | |
|---|---|---|---|---|---|
| 365,714 | A | | 6/1887 | Warner | |
| 1,222,366 | A | * | 4/1917 | Curry | 30/286 |
| 1,282,322 | A | * | 10/1918 | Trepto | 279/45 |
| 1,426,184 | A | * | 8/1922 | Hammar | 30/286 |
| 1,593,935 | A | * | 7/1926 | Gerick et al. | 30/286 |
| 4,980,977 | A | | 1/1991 | Matin et al. | |
| 5,116,351 | A | * | 5/1992 | Frassetti | 606/167 |
| 5,250,064 | A | * | 10/1993 | Schneider | 606/167 |
| 5,478,346 | A | | 12/1995 | Capewell | |
| 5,852,874 | A | * | 12/1998 | Walker | 30/2 |

* cited by examiner

*Primary Examiner* — Omar Flores Sanchez
(74) *Attorney, Agent, or Firm* — Mark R. Malek; Zies Widerman & Malek

(57) ABSTRACT

A shielded knife includes a base, a blade secured to the base at a first end and a guard operatively attached to the blade at a second end opposite the base. The guard may be rotated between a closed position covering a sharpened edge of the blade and an opened position exposing the sharpened edge of the blade.

6 Claims, 12 Drawing Sheets

SHIELDED KNIFE AND ASSOCIATED METHODS

FIELD OF THE INVENTION

The present invention relates to the field of knives and, more specifically, to shields to prevent exposure of the blade of the knife when not in operation.

BACKGROUND OF THE INVENTION

For a substantial part of human history, knives have been an essential device used in our everyday lives. Whether used as a weapon, tool, food preparation utensil, or other application, knives generally include the same defining feature: a sharpened blade.

The sharpened blade allows the knife to pierce, slice, trim, and otherwise cut a target object. Unfortunately, the sharpened blade also presents a potential hazard to a user if the knife is mishandled. As a result, protective devices and features have been created to address the potential danger of handling knives.

Developed substantially before the formation of the U.S. Patent and Trademark Office, knife sheaths have been used to allow a user to store or carry a knife with a substantially reduced risk of being injured by the sharpened blade of the knife. Although the knife sheath can provide some protection from the sharpened blade, the knife must be actively placed in the sheath for the sheath to be effective. Additionally, one could lose the sheath, and therefore be required to find a replacement sheath or permanently expose themselves to potential injury.

To overcome the limitations inherent to the sheath, some inventors have created systems of knife guards attached to the knife structure itself. U.S. Pat. No. 5,478,346 to Capewell, discloses a scalpel having a guard member that is connected to the handle of the scalpel and covers the blade of the scalpel. The guard member of the Capewell '346 patent is connected to the scalpel handle so that as the guard member pivots away from the scalpel blade, towards the handle. U.S. Pat. No. 5,250,064 to Schnider discloses a guard for a surgical scalpel, which includes an engagement portion to pivotally move the guard upward away from the scalpel blade and towards the scalpel handle. However, the guard of the Schnider et al. '064 patent is connected to the handle of the scalpel, and not the blade itself. Additionally, U.S. Pat. No. 4,980,977 to Martin, et al., discloses a cutting knife for cutting honey comb core and other materials. The cutting knife disclosed in the Martin et al. '977 patent includes a blade guard that is pivotally connected to the blade using a fastener that is passed through outer body portions of the guard and through the blade itself. However, the connection between the guard and the handle in the cutting tool of the Martin et al. '977 patent is overly complicated. Finally, U.S. Pat. No. 365,714 to Warner, discloses a knife having a blade guard pivotally connected to a portion of the handle and, presumably, connected to the blade itself. Again, this blade guard pivots upwardly away from the blade and towards the handle.

Although the knife guards disclosed in the cited references provide a means to cover a knife blade, the cited references do so via a guard attached on the near the base of the knife. Attaching the guard to the knife near the position where the blade interfaces with the base may render the knife cumbersome in operation. In other applications, attaching a guard at this aforementioned location may require an overly complicated design, which interferes with simplicity of use inherent to a knife.

There exists a need for a knife that provides an ability to guard the sharpened edge of the blade when not in use, while easily exposing the sharpened edge of the blade when its use is required, and without requiring the burden of an excessively complex or cumbersome design.

SUMMARY OF THE INVENTION

With the foregoing in mind, the present invention advantageously provides a knife guard that covers the sharpened blade edge of a knife during periods of non-use, while not interfering with the cutting and slicing functionality of the knife during periods of operation. The present invention also advantageously provides the blade covering functionality without the complexity present in the knife guards defined by the disclosed references. The present invention further advantageously decreases exposure to personal injury hazards inherent to operating a bladed knife.

These and other objects, features and advantages according to the present invention are provided by a shielded knife having a base and a blade connected thereto. More specifically, the blade may have an upper blade end and a sharpened lower blade portion. The shielded knife may also include a guard pivotally connected to the blade along at least one pivot axis, and at least one connection member that operatively connects the guard to the blade.

The blade may further include a first blade end attached to the base and a second blade end opposite the first blade end. The upper blade portion may further extend from the first blade end to the second blade end. Similarly, the lower blade portion may also extend from the first blade end to the second blade end.

The guard may be movable between an opened position and a closed position. The closed position may be defined as the guard engaging the blade to substantially cover the blade. The opened position of the guard may be defined as a lower portion of the guard being pivoted away from the sharpened lower end so that the blade is substantially exposed. The guard may include a top, a pair of opposing sidewalls extending downwardly from the top so that the guard is a sleeve that is adapted to cover the blade when the guard is in the closed position.

The connection member may connect the second guard end to the second blade end at the pivot axis point. The connection member may further attach the guard to the blade through at least one connection member slot formed through the guard. Additionally, the at least one connection member slot may further define a path of rotational direction of the guard as the guard is moved between the opened and closed positions.

A method aspect of the present invention is for using the shielded knife. The method may include moving the guard between a closed position and an opened position. The method may further include pivoting the guard about a pivot axis that is substantially orthogonal to the blade.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. Prime and multiple prime notations, when used, indicate like elements in alternate embodiments.

In this detailed description of the present invention, a person skilled in the art should note that directional terms, such as "above," "below," "upper," "lower," and other like terms, are used for the convenience of the reader in reference to the drawings. Also, a person skilled in the art should notice this description may contain other terminology to convey position, orientation, and direction without departing from the principles of the present invention.

Embodiments of the present invention are described herein using the context of an apparatus for guarding the blade of a knife when the knife is not in use for food preparation. Those of ordinary skill in the art will realize that the following embodiments of the present invention are only illustrative and are not intended to be limiting in any way. Other embodiments of the present invention will readily suggest themselves to such skilled persons having the benefit of this disclosure.

Figure 1:
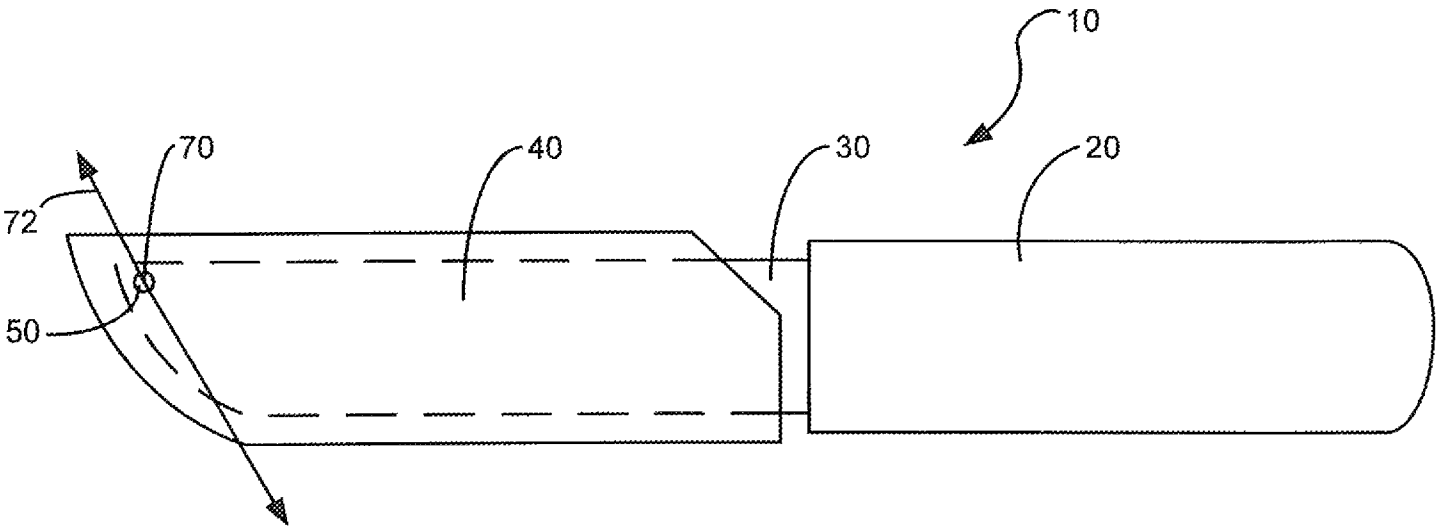
FIG. 1 is a side elevation view of a shielded knife according to the present invention illustrating a blade that is covered with a guard.

FIG. 1 illustrates a shielded knife 10 in accordance with an embodiment of the present invention. Generally, the shielded knife 10 includes a base 20, a blade 30, and a guard 40. The guard 40 may be operatively connected to the blade 30 via a connection member 50. Those skilled in the art will appreciate that the base 20 may, for example, also be referred to as a handle and may be provided by any type of device that allows for a user to readily grasp.

Figure 2:
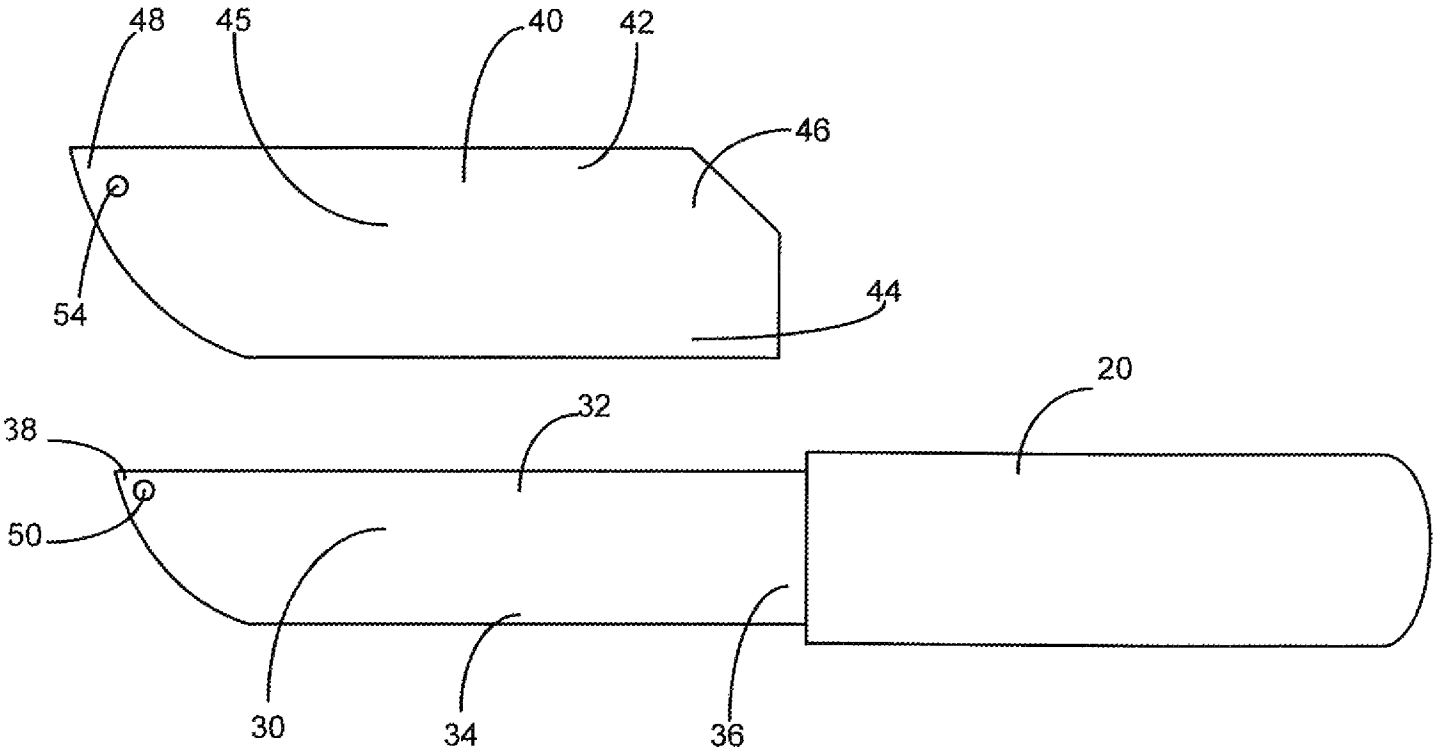
FIG. 2 is an exploded side elevation view of the shielded knife illustrated in FIG. 1.

FIG. 2 illustrates various components of the embodiment of the shielded knife 10 illustrated in FIG. 1 in greater detail. As indicated above, the base 20 may provide a surface that can be grasped during operation, so that the shielded knife 10 may be operated while simultaneously decreasing the risk of injury to the user. The base 20 may be constructed of virtually any material which may be readily handled and connected to the blade 30 via a connector. For example, the connector to connect the base 20 to the blade 30 of the shielded knife may be provided by bolts, rivets, adhesives, or other connection means that would be known to a person of skill in the art.

The blade 30 of the shielded knife 10, according to the present invention, includes a sharpened edge that may be used to engage the food (or other items) to be cut or sliced by the shielded knife 10 during operation. A person of skill in the art, after the having had the benefit of this disclosure, will realize additional uses for a blade 30 of a shielded knife 10 according to this embodiment of the present invention. The blade may include a first blade end 36 that may be connected to, and extend from, the base 20. The blade 30 may continue to extend from the first blade end 36 along a remaining length of the blade 30 until a termination point of the blade 30 at a second blade end 38.

Additionally, the blade 30 may include an upper blade portion 32 and a lower blade portion 34. In the present embodiment, the upper blade portion 32 may span a predetermined length between the first blade end 36 and the second blade end 38 of the blade 30. The predetermined length may be based on the size of the knife that is desired to be manufactured. Accordingly, the skilled artisan will appreciate that the shielded knife 10 according to the present invention may be provided with any size blade 30 and corresponding guard 40. The upper blade portion 32 may be unsharpened or dull, but the present invention contemplates that the upper blade portion 32 may also be sharpened, or may include some portions that are sharpened and/or serrated, as understood by those skilled in the art. Additionally, the lower blade portion 34 may span a predetermined length between the first blade end 36 and the second blade end 38. The lower blade portion 34 of the blade 30 may be sharpened and/or serrated. Those skilled in the art will appreciate that the present invention contemplates that the lower blade portion 34 may also include portions that are sharpened and/or serrated.

The upper blade portion 32 and the lower blade portion 34 may come to a point at the second blade end 38, although a skilled artisan will realize that the blade 30 of the shielded knife 10 according to the present invention may also terminate without coming to a point. As a non-limiting example, a "butcher's knife" illustrates a type of knife that does not terminate at a point defined by a meeting of the upper blade portion 32 and the lower blade portion 34. Accordingly, the shielded knife 10 according to the present invention may be used in connection with any embodiment of a knife, i.e., chopping knife, butcher knife, bread knife, or any other type of knife as understood by those skilled in the art. As indicated above, the shielded knife 10 may be sharpened on both the upper blade portion 32 and the lower blade portion 34 and may terminate at a point centrally located between the upper blade surface 32 and the lower blade surface 34. A person of skill in the art will realize that the present invention is meant to include additional embodiments of alternate combinations of sharpened or dulled portions of the blade 30, and different convergent structures of the upper blade portion 32 and the lower blade portion 34.

The blade 30 of the shielded knife 10 according to the present invention may be constructed of a hardened material. Some examples, not intended to limit this disclosure, of hardened materials that may be used to construct the blade 30 may include metal, plastic, wood, ceramic, composites and other materials suitable to construct the blade 30 of a shielded knife 10. A person of skill in the art will realize, after having had the benefit of this disclosure, that additional suitable material may be used to construct the blade 30 of the shielded knife according to the present invention.

Figure 3:
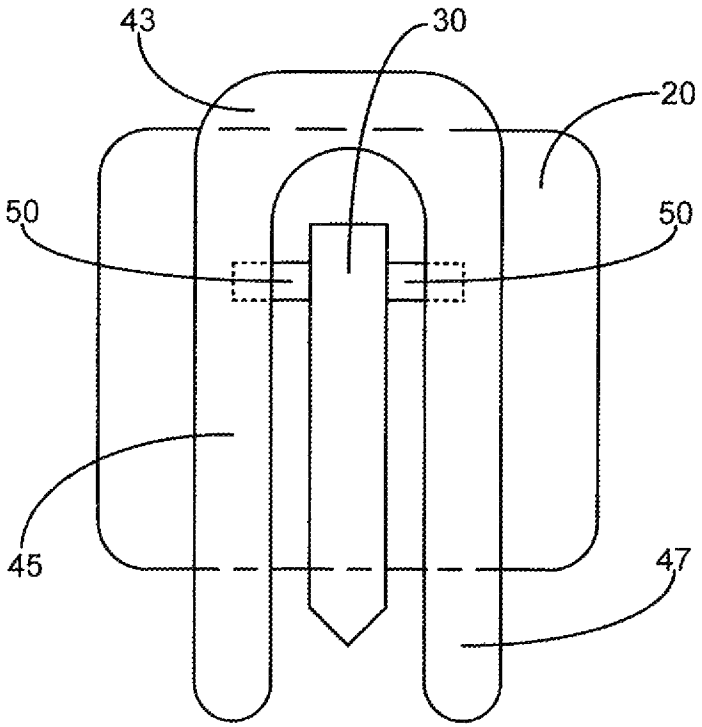
FIG. 3 is a front elevation view of the shielded knife illustrated in FIG. 1.
Figure 4:
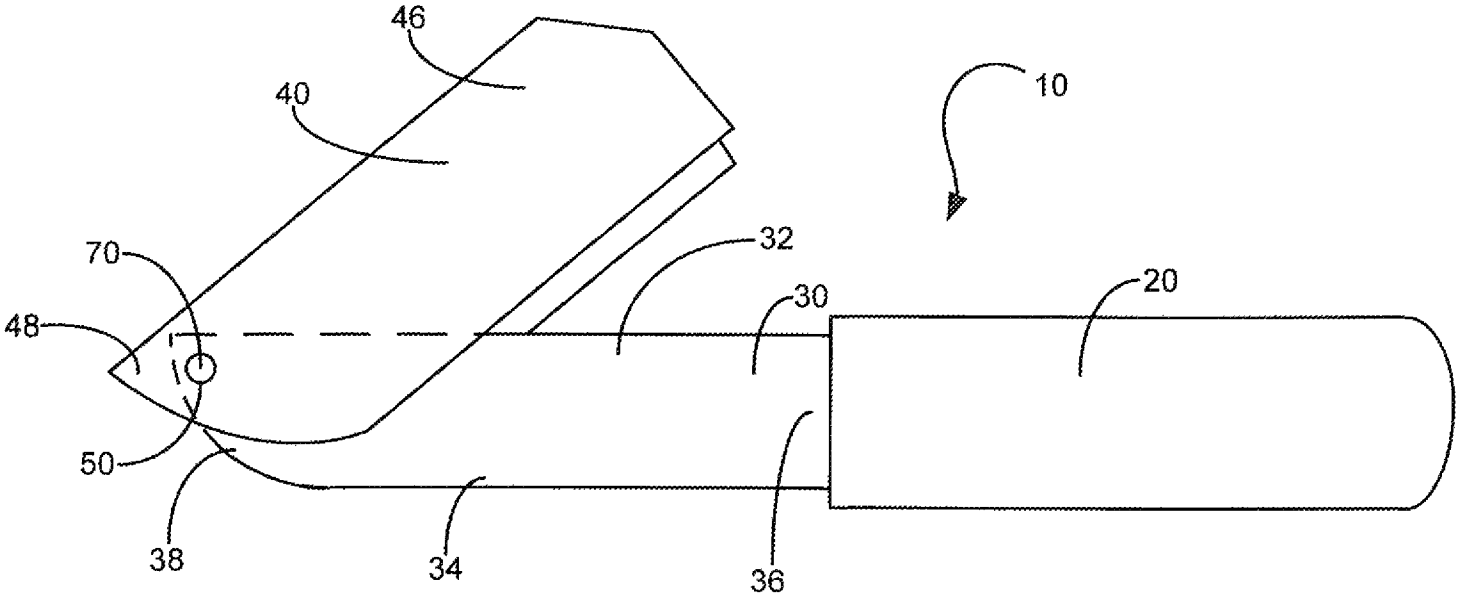
FIG. 4 is a side perspective view of the shielded knife illustrated in FIG. 1 showing the guard in an opened position so that the blade of the shielded knife is exposed.

FIGS. 2-3 illustrate a guard 40 of the shielded knife 10 according to the present invention, which may be positioned to substantially cover the blade 30 of the shielded knife 10. In one embodiment of the present invention, the guard 40 may be rotatably moved between a closed position (FIG. 1) and an opened position (FIG. 4). In the interest of clarity, the guard will initially be described in the closed position.

As illustrated in FIG. 2, the guard 40 may extend from a first guard end 46, which may substantially cover a portion of the blade 30 at the first blade end 36, and continue the length of the guard 40 to the second guard end 48, which may substantially cover a portion of the blade 30 at the second blade end 38. As further illustrated in FIGS. 2-3, the guard 40 may include guard sidewalls 45, 47 connected to a guard top 43. The guard sidewalls 45, 47 may include a lower sidewall portion 44, which may be positioned to cover the lower blade portion 34 of the blade 30 when the guard is in the closed position. The guard sidewalls 45, 47 may also include an upper sidewall portion 42 that is substantially opposite the lower sidewall portion 44 and which may be positioned to cover the upper blade portion 32 of the blade 30 when the guard is in the opened position.

The guard 40 may connect to the blade 30 via a connection member 50, which may interface with a respective connection member slot 54. The connection member 50 can be any elongated protrusion, which may be received by a connection member slot 54. In one embodiment, the connection member 50 may be provided by pegs, or other elongated structures, that extends outwardly from a side surface of the blade 30. The connection member 50 may be received by connection member slots 54, which may be formed in the sidewalls 45 and/or 47 of the guard 40. The embodiment of the shielded knife 10 illustrated in FIG. 2, for example, shows the connection member slots 54 as being provided by holes, depressions, or areas where material from the guard 40 has been removed. The connection member slot 54 is preferably configured to receive and secure the connection member 50. The connection member 50 may be a screw or bolt that is inserted through the connection member slots 54 located on the guard 40 and/or blade 30.

The connection member 50 may be located on the blade 30 at the second blade end 38. A corresponding connection member slot 54 may be located on the guard 40 at the second guard end 48. The connection member 50 may be located in alternate locations, such as on the first blade end 36 of the blade 30, the second guard end 48 of the guard 40, or the first guard end 46 of the guard. The connection member slot 54 may, similarly, be located in alternate locations, such as on the first blade end 36 of the blade 30, the second blade end 38 of the blade 30, or the first guard end 46 of the guard 40. Additionally, the knife 10 may include many variations of connection members 50 and connection member slots 54, with which the variations may be located on the blade 30 or guard 40, and configured such that the connection member slot 54 may receive the connection member 50. A person of skill in the art will realize additional configurations that are within the scope and spirit of the present invention.

Those skilled in the art will also appreciate that the connection between the guard 40 and the blade 30, i.e., the connection member 50 and connection member slot 54 combination, may be provided in other ways. For example, the connection member 50 may be provided by a fastener that passes through the connection member slot 54 to connect the guard 40 to the blade 30. More specifically, the connection member slot 54 may be defined by a passageway that is formed through the guard 40 and the blade 30. Accordingly, the passageways formed through the blade 30 and through the guard 40 are preferably aligned when the guard 40 is connected to the blade 30. The fastener may, for example, be a bolt that is threaded on both ends and that is fastened in place with a pair of nuts. When the nuts are threadably connected to the bolt, the guard 40 remains pivotally connected to the blade 30. Although the fastener of the connection member 50 is described herein as a bolt, those skilled in the art will appreciate that any type of fastener may be used to connect the guard 40 to the blade 30.

The following embodiments of the present invention are illustrative, and are not intended to be limiting. A person of skill in the art will realize additional operational variation that, while being variations of the following examples, will still enable the performance of the shielded knife 10, as disclosed herein, and within the scope and spirit of the present invention. Further, although the illustrative operational methods of the present invention are related to food preparation, a person of skill in the art will realize that the shielded knife 10 according to the present invention is capable of performing additional functions traditionally associated with a knife.

In operation, the shielded knife 10 of the present invention utilizes a guard 40 to shield a blade 30. The guard may be alternated between a closed position, an opened position, and any intermediate position included therein via rotation of the guard about a pivot axis 72 (FIG. 1). As discussed above, the pivot axis 72 intersects a blade plane (a plane that bisects the blade), at an approximately orthogonal angle, through a pivot axis point 70 (FIG. 1). The pivot axis point 70 may be located on the blade 30. A person of skill in the art will appreciate additional configurations which result in alternate locations of the pivot axis 70 and therefore the pivot axis point 72. In some instances, the pivot axis point 70 may not be located on the blade 30, such as, for example, in configurations where the connection slot 54 is elongated.

In the closed position, as illustrated in FIGS. 1, 3, 7, 9, and 11, the guard 40 may substantially cover the blade 30. In the closed position, the shielded knife 10 provides an increased level of protection against unwanted injury or accidental contact with the blade 30 when not in use. Those skilled in the art will appreciate that there is an inherent level of risk associated with using a knife of any kind, especially when a sharpened portion of a blade of a knife is exposed. When the shielded knife according to the present invention is in the opened position, as illustrated in FIGS. 4, 5, 8, 10, and 12, the guard 40 may be positioned such that a substantial portion of the sharpened lower blade portion 34 may be exposed. In the opened position, the shielded knife 10 may be used to cut, slice, chop, or other perform operations commonly associated with a knife.

When the shielded knife 10, according to the present invention, is desired to be used for preparing food or performing other knife-related functions, the guard 40 of the knife 10 may be pivotally moved, i.e., rotated, from the closed position to the opened position. Preferably, the guard 40 may be attached to the blade 30 at the pivot axis point 70, by a connection between the connection member 50 and a respective connection member slot 54. As indicated above, the connection between the guard 40 and the blade 30 allows for the guard 40 to be readily rotated between the opened and the closed positions so that the blade 30 of the shielded knife 10 may be readily exposed when use is desired and shielded when use is not desired. A person of skill in the art will realize additional attachment configurations that also allow the position of the guard 40 to be altered from the closed position to the opened position, and any intermediary position therein.

The guard 40 may be positioned from the closed position to the open position by operation of the knife 10. More specifically, the object being cut or sliced by the blade 30 may apply a predetermined amount of pressure to the guard 40, causing the guard 40 to rotate away from the sharpened lower blade portion 34 of the blade 30 as the blade is being used to cut or slice through the object. Similarly, when the blade 30 is moved away from the object being cut or sliced by the blade 30, the weight of the guard 40 preferably causes the guard 40 to reposition itself into the closed position.

Figure 5:
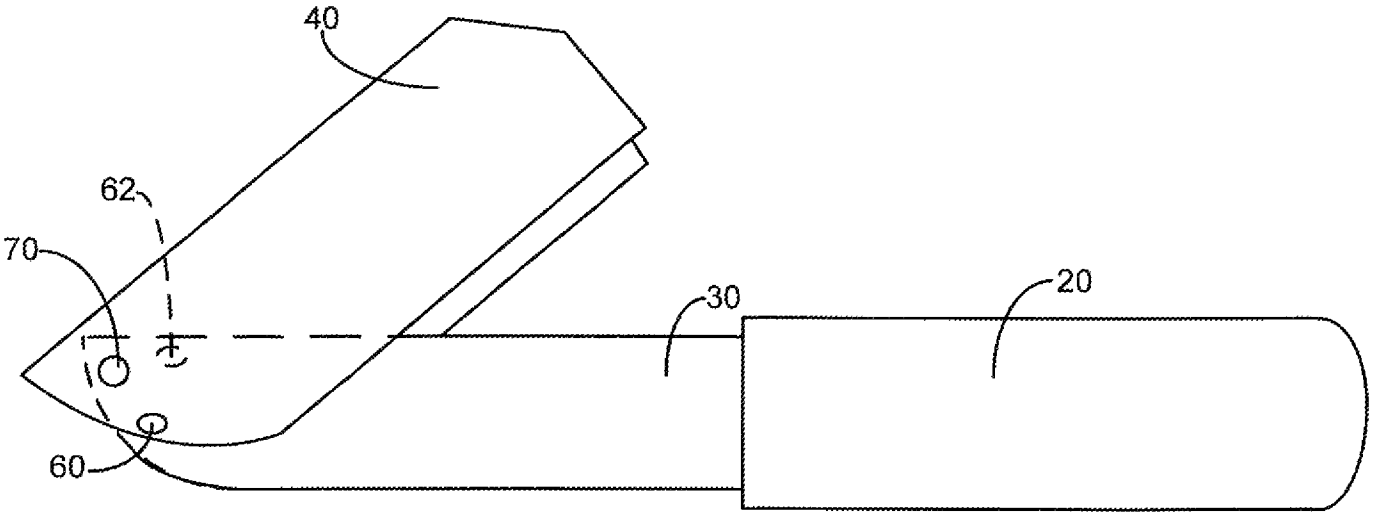
FIG. 5 is a side perspective view of an embodiment of the shielded knife according to the present invention illustrating a locking member and a locking receiver.
Figure 6:
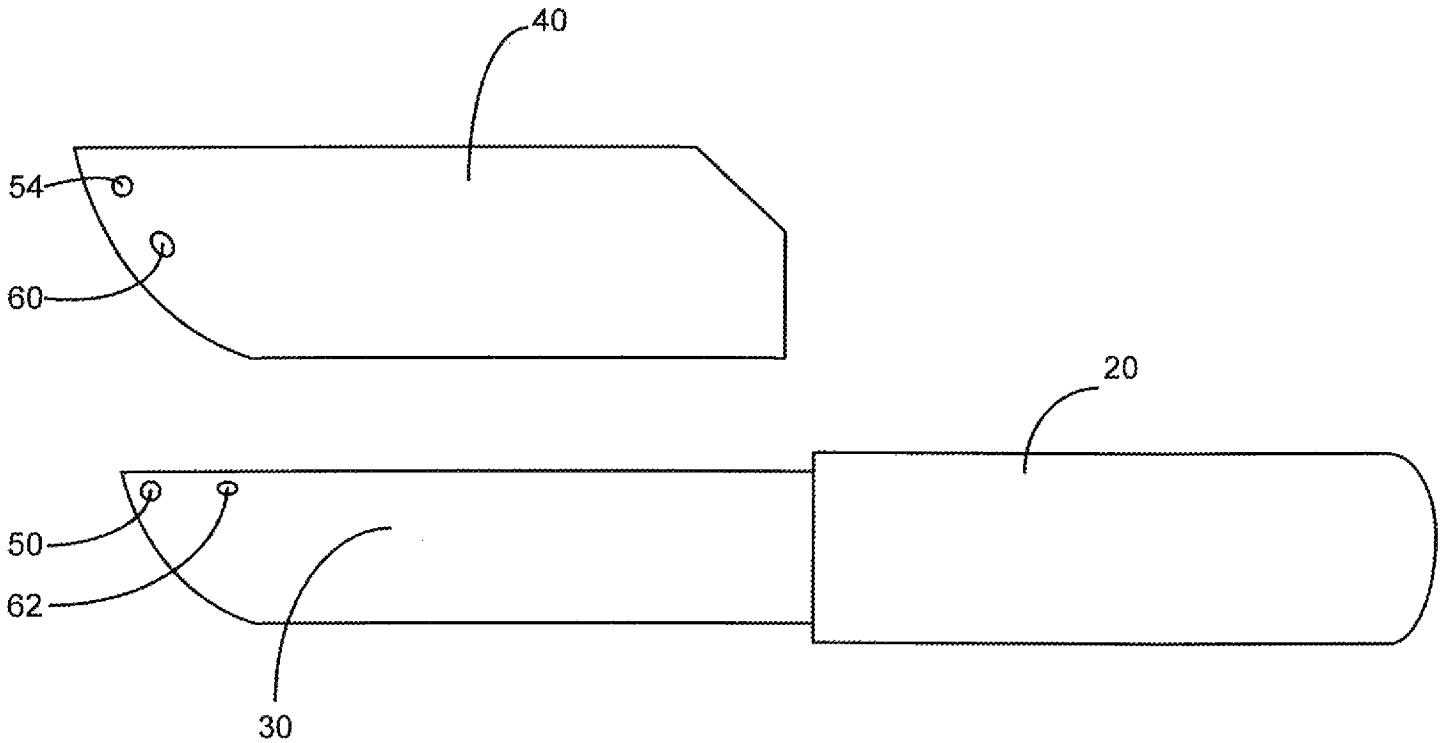
FIG. 6 is an exploded side elevation view of the shielded knife illustrated in FIG. 5.

In some embodiments, the shielded knife 10 according to the present invention may include a locking member 60 and a locking receiver 62, as perhaps best illustrated in FIGS. 5 and 6. A locking receiver 62 may be configured to receive and secure a locking member 60. The locking member 60 may be a protrusion extending from the surface of the blade 30, which may be captured and secured by a corresponding depression formed on an interior portion of the guard sidewall 45 and/or 47. In this configuration, the locking member 60 may be secured by the natural flexibility provided of the materials used to construct the guard sidewalls 45 and/or 47. In another configuration, the locking member 60 may be a spring-loaded stub, or an elongated or protruding member, that projects outward from the side surface of the blade 30, and configured to be received by the locking receiver 62 on the guard 40. A person of skill in the art will realize that the locking member 60 may be located in various locations on the blade 30 or guard 40 and retain the functionality as disclosed herein. Similarly, a person of skill in the art will realize that the locking receiver 62 may be located on various locations of the blade 30 or guard 40 as disclosed herein.

In one embodiment of the shielded knife 10, which includes a locking member 60 or locking receiver 62, the guard 40 may be constructed from a material having elastic properties, such as, but not limited to, tempered metal or hardened plastic. In this embodiment, the locking receiver 62 may be constructed as a depression or hole in the guard sidewalls 45, 47 of the guard 40. Once the locking member 60 has been received by the locking receiver 62, the natural springing properties of the guard material may allow inward compression of the sidewalls 45, 47 to apply an adequate pressure on the locking member 60 and hold the guard 40 in a fixed position. According to disclosure for the present embodiment, the guard 40 may be unlocked by applying adequate pressure to the guard top 43 of the guard, pushing the guard 40 into the closed position. The pressure applied to close the guard 40 must be sufficient to overcome the natural springing pressure applied by the sidewalls 45, 47 to the locking members 60.

Those skilled in the art will appreciate that the locking member 60 may be positioned into a locking receiver 64 using a spring located between the locking member 60 and the blade 30. In this embodiment, the spring may apply a sufficient pressure to hold the locking member 60 into the locking receiver 62, thus holding the guard 40 in a locked position. Those skilled in the art will also appreciate that the locked position applies when the guard 40 is in both the opened position and the closed position. In other words, the guard 40 may be positioned in the locked position when the guard 40 is in the closed position to maintain the guard 40 in the closed position, therefore advantageously decreasing the risk that the guard 40 may move to the opened position in an unintended manner and expose the sharpened edge of the blade 30.

Additional structural configurations which use pressure or friction between the locking member 60 and the locking receiver 62 to hold the guard 40 in a locked position are intended to be included within the scope and spirit of the present invention, and will be readily understood by those skilled in the art. As described above, a skilled artisan will realize that the guard may be locked in the closed position, opened position, or any intermediary position therebetween, in accordance to the scope and spirit of the present invention. Furthermore, a skilled artisan will realize that although the locking member 60 has been described as attached to the blade 30 and the locking receiver 62 has been described as attached to the guard 40, the locking member 60 may be located in alternate locations, such as on the first blade end 36 of the blade 30, the second guard end 48 of the guard 40, or the first guard end 46 of the guard. Also, the locking receiver 64 may be located in alternate locations, such as on the first blade end 36 of the blade 30, the second blade end 38 of the blade 30, or the first guard end 46 of the guard. The locking member 60 and the locking receiver 62 of the shielded knife 10 according to the present invention, regardless of location, are meant to be used in connection with one another in order to ensure that the guard 40 may be locked in a desired position.

Figure 7:
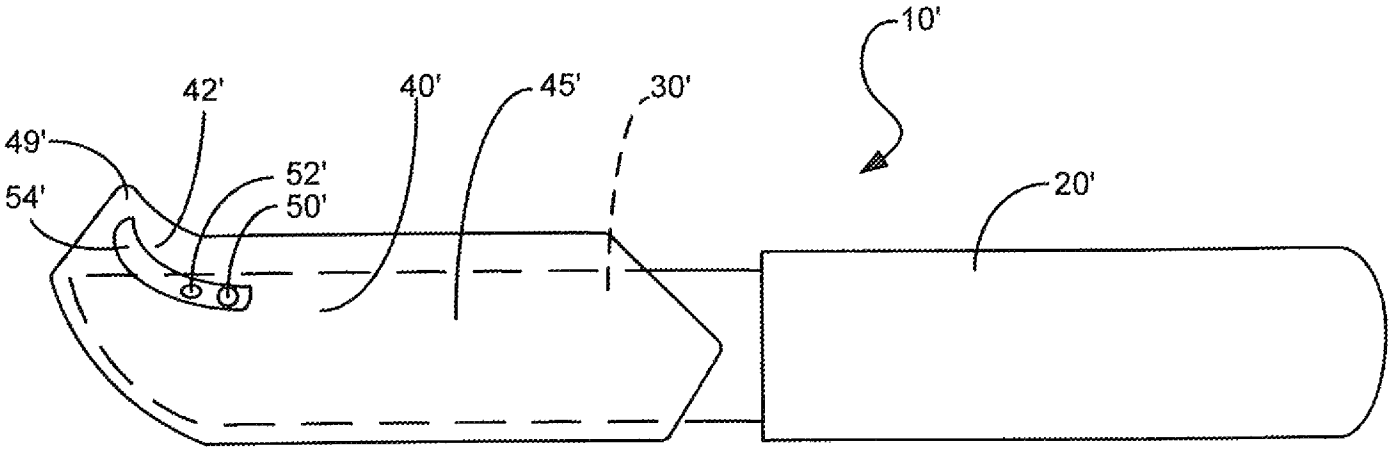
FIG. 7 is a side elevation view of an embodiment of a shielded knife according to the present invention having a plurality of connection members.
Figure 8:
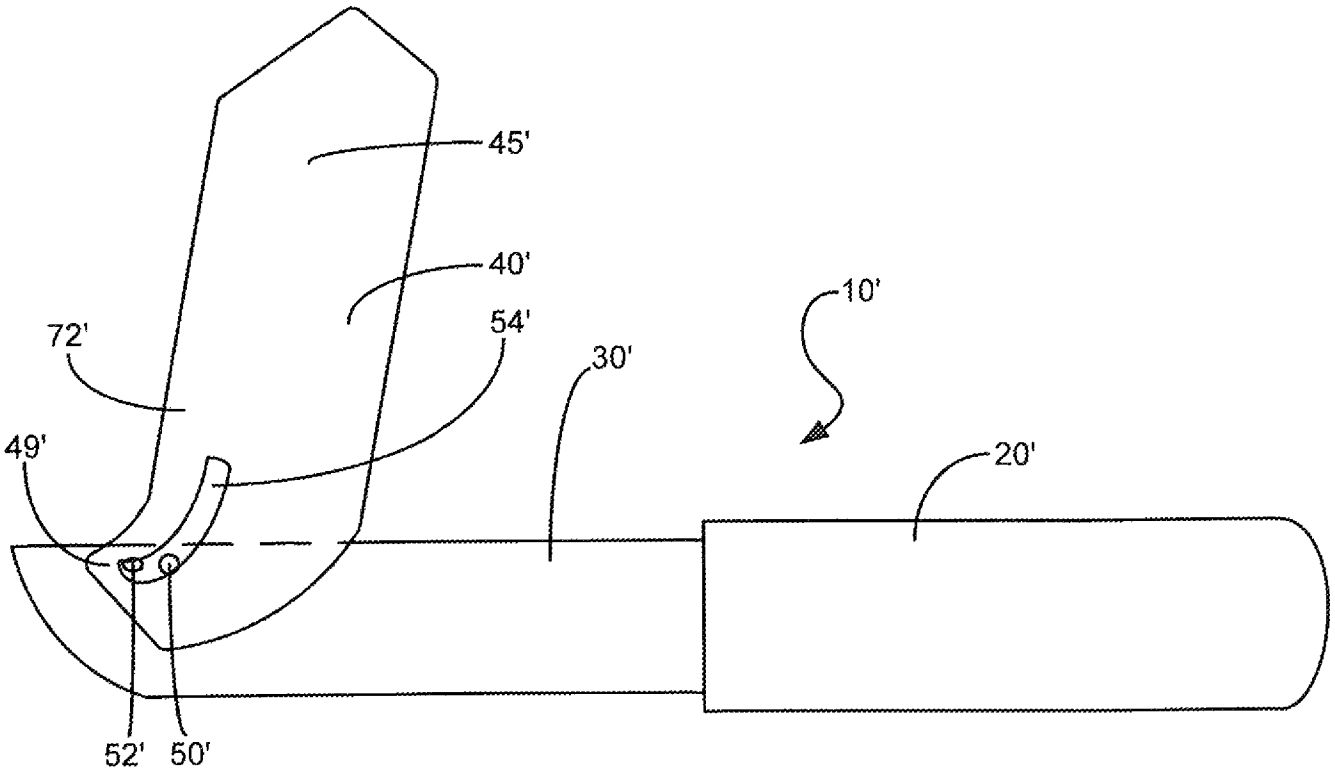
FIG. 8 is a partial side elevation view of the shielded knife illustrated in FIG. 7 showing the guard in an opened position so that the blade of the shielded knife is exposed.

Referring now additionally to FIGS. 7-8, an alternate embodiment of the shielded knife 10' according to the present invention is now described in greater detail. The embodiment of the shielded knife 10' according to-the present invention may include a plurality of connection members 50' and an elongated connection member slot 54'. Referring more specifically to the shielded knife 10' illustrated in FIGS. 7-8, the blade 30' may include two connection members 50', 52' in close proximity to each other. A person of skill in the art will realize that more than two connection members 50', 52' may be used, as included within the scope and spirit of the present invention. Additionally, a skill artisan will realize that one single (or multiple) elongated connection member(s) 50' may be received by the elongated connection member slot 54', used to guide the rotation of the guard 40' as it is rotated from the closed position to the opened position. By including the elongated connection member slot 54' and connection member 50' as described herein, the guard 40" is able to rotate in a manner that exposes a larger portion of the blade 30', which may include the tip of the blade, during operation of the present invention.

The embodiment of the shielded knife 10' illustrated in FIGS. 7-8 is shown as having two connection members 50', 52' attached to one side of the blade 30'. The elongated connection member slot 54' is located on the guard sidewall 45' of the guard 40'. Only one guard sidewall 45' is shown, but the skilled artisan will appreciate that the opposing guard sidewall 47' (not shown in FIGS. 7-8) may also have an elongated connection member slot 54' formed therein. The elliptical configuration of the elongated connection member slot 54' advantageously provides for smooth rotational motion of the guard 40' when being moved between the opened and the closed positions. The elongated connection member slot 54' also advantageously allows for an additional portion of the blade 30' to be exposed when the guard 40' is in the opened position. Further, in embodiments, the guard 40' may include an extended portion 49'. The extended portion 49' is an elongated portion of the guard sidewall 45', extending above the upper sidewall portion 42' of the guard 40'. The extended portion 49' provides additional surface area on the guard sidewall 45'. The elongation of the connection member slot 54' may be extended into the additional surface area provided by the extended portion 49', resulting in a lengthier elongation of the connection member slot 54'.

Although this embodiment of the shielded knife 10' illustrates the connection member slot 54' being formed in one side of the guard 40', and the connection member being positioned on one side of the blade 30', the skilled artisan will appreciate that the combination of the connection member slot 54' and connection member 50', 52' may be included on either side of the guard 40'/blade 30' or both sides of the guard/blade. The remaining features of this embodiment of the shielded knife 10' are similar to those of the first embodiment of the shielded knife 10, are labeled with prime notation, and require no further discussion herein.

Figure 9:
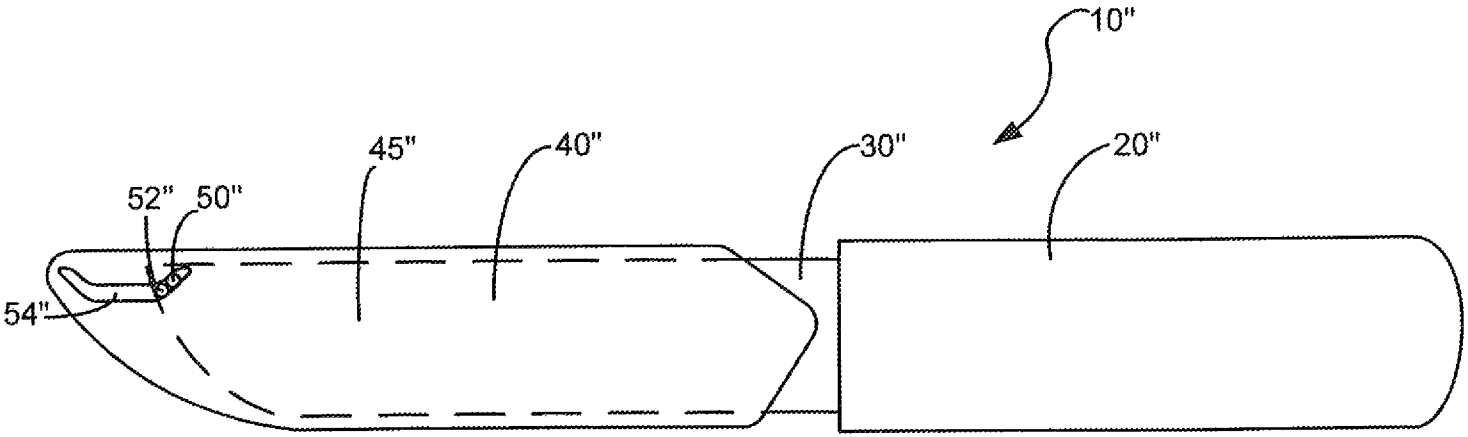
FIG. 9 is a side elevation view of an additional embodiment of a shielded knife according to the present invention showing the guard in a closed position to cover the blade of the shielded knife.
Figure 10:
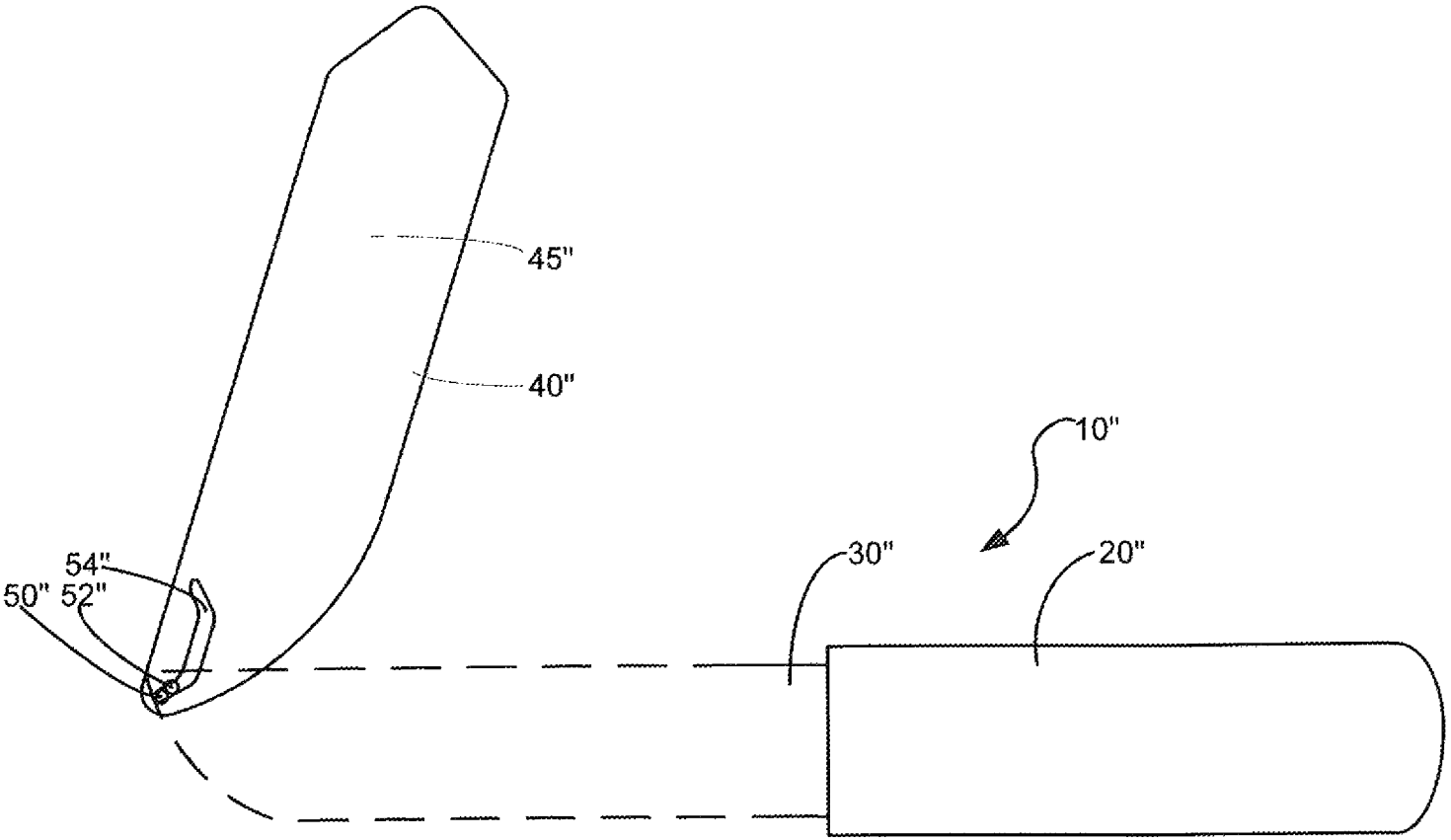
FIG. 10 is a partial side elevation view of the shielded knife illustrated in FIG. 9.

Another embodiment of the shielded knife 10" according to the present invention is illustrated in FIGS. 9-10. This embodiment of the shielded knife 10" includes two connection members 50", 52' attached to at least one side of the blade 30". This embodiment of the shielded knife 10" also includes an arcuate, elongated connection member slot 54" located on the guard sidewalls 45" of the guard 40". Only one guard sidewall 45" is shown, but the skilled artisan will appreciate that the opposing guard sidewall 47" (not shown in FIGS. 9-10) may also have an elongated connection member slot 54" formed therein. The arcuate configuration of the elongated connection member slot 54" allows an additional portion of the blade 30" to be exposed when the guard 40" is in the opened position without the use of the extended portion 49" present in the prior embodiment of the shielded knife 10".

Because the current embodiment of the shielded knife 10" includes the arcuate elongated connection member slot 54", it may provide exposure of substantially the entire blade 30" without the requirement of an extended portion 49' of the guard 40' of the prior embodiment. In this embodiment of the shielded knife 10", the shape of the connection member slot 54" may include a plurality of different angles. The connection members 50", 52" may be positioned at different locations on the blade 30", maintaining a constant distance apart from one another. As the connection members 50", 52" travel through the arcuate connection member slot 54", the guard 40" may reorient to accommodate the connection members 50", 52". As a result, the guard 40" may be positioned into a plurality of angles respective to the blade 30", with at least one angle being capable of exposing substantially the entire blade 30". Preferably, this angle of the guard 40" with maximum exposure of the blade 30" is the opened position.

Although this embodiment of the shielded knife 10" illustrates the connection member slot 54" being formed in one side of the guard 40", and the connection member being positioned on one side of the blade 30', the skilled artisan will appreciate that the combination of the connection member slot 54" and connection member 50", 52" may be included on either side of the guard 40"/blade 30" or both sides of the guard/blade. The remaining features of this embodiment of the shielded knife 10" are similar to those of the first embodiment of the shielded knife 10, are labeled with double prime notation, and require no further discussion herein.

Figure 11:
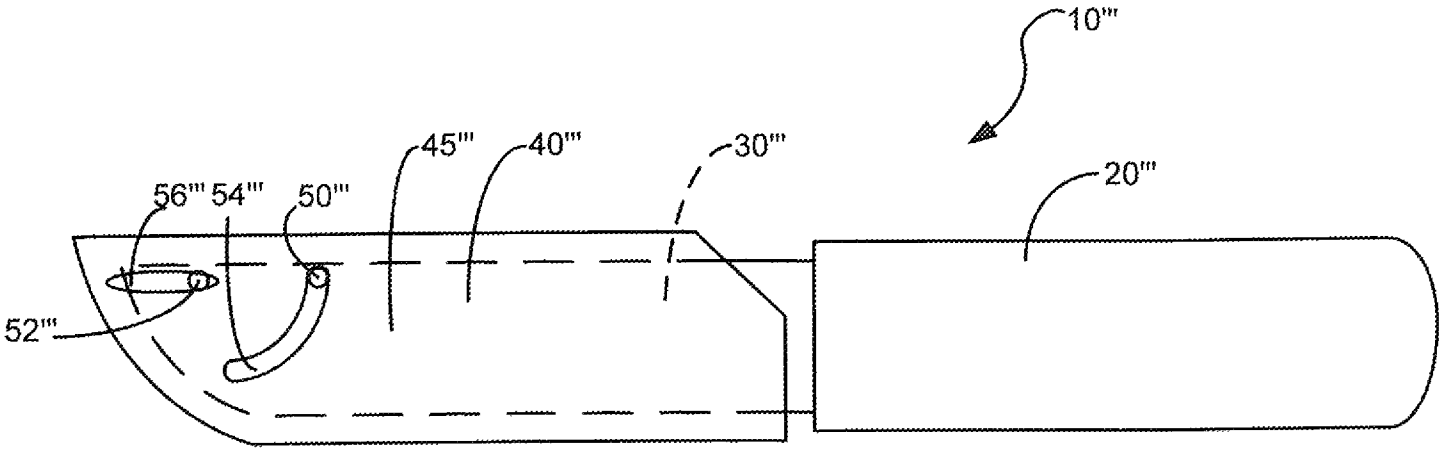
FIG. 11 is a side elevation view of an embodiment of a shielded knife according to the present invention having a plurality of connection members and a plurality of connection member slots.
Figure 12:
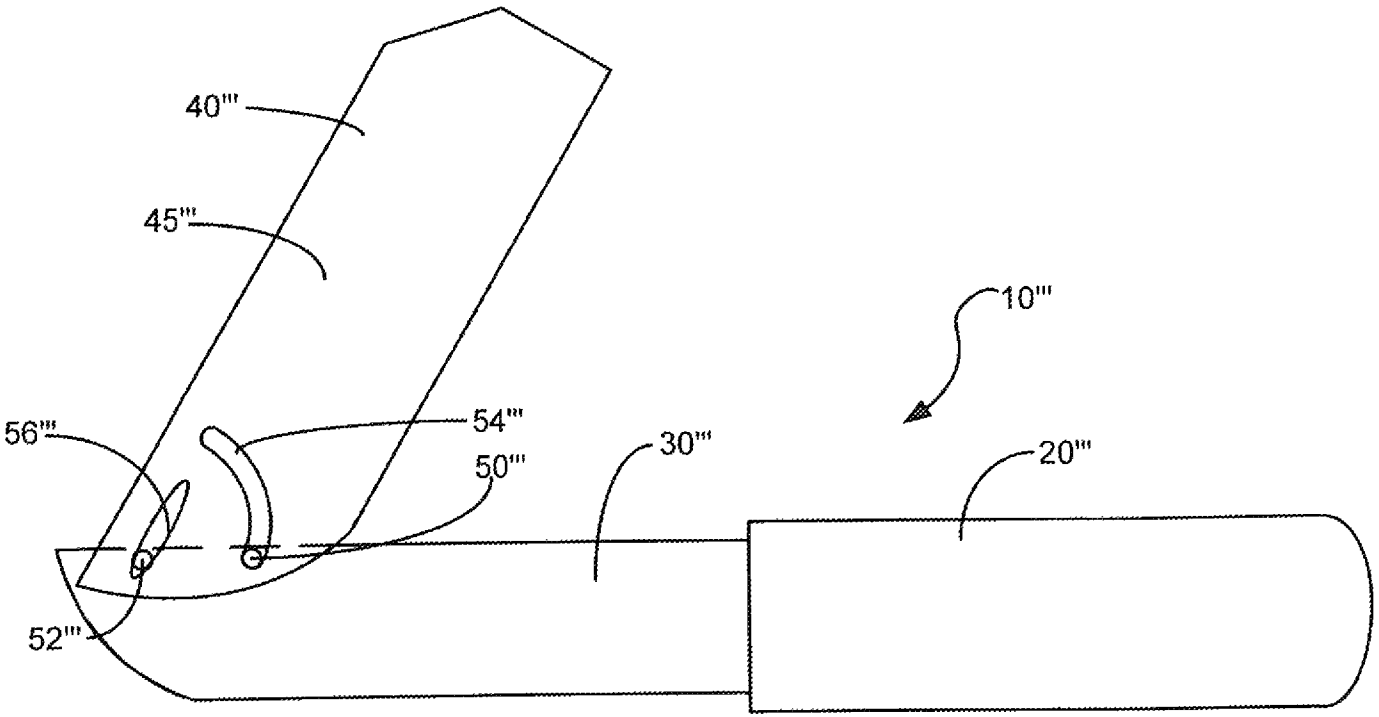
FIG. 12 is a side elevation view of the shielded knife illustrated in FIG. 11.

FIGS. 11-12 illustrate another embodiment of the shielded knife 10''' according to the present invention. This embodiment of the shielded knife 10''' includes two connection members 50''', 52''', which are attached to the side of the blade 30''' and two elongated connection member slots 54''', 56''' located on the guard sidewall 45'''. Only one guard sidewall 45''' is shown, but the skilled artisan will appreciate that the opposing guard sidewall 47''' (not shown in FIGS. 11-12) may also have an elongated connection member slots 54''', 56''' formed therein.

The inclusion of multiple connection member slots 54''', 56''' provides an additional level of control and stability for the guard 40''' as it is repositioned from the closed position to the opened position. The connection member slots 54''', 56''' may be positioned at different locations on the guard 40''' and configured as a plurality of angled, curved, elliptical, or arcuate slots. The connection members 50''', 52''' are maintained at a constant distance apart from one another. As the connection members 50''', 52' travel through the connection member slots 54''', 56''', the guard 40''' reorients to accommodate the connection members 50''', 52'''. As a result, the guard 40''' may be positioned into a plurality of angles respective to the blade 30''', with at least one angle being capable of exposing substantially the entire blade 30'''. Preferably, this angle of the guard 40''' with maximum exposure of the blade 30''' is the opened position.

In this embodiment, the connection member slots 54''', 56''' are positioned to receive the connection members 50''', 52''', respectively. As the guard 40''' is moved into the opened position, connection members 50''', 52''' travel through their respective connective member slots 54''', 56'''. The inclusion of a plurality of connection member slots 54''', 56''', and the connection members 50''', 52''' being positioned therein, allows the guard to travel smoothly while transitioning between the closed position and the opened position. The placement of the connection members 50''', 52''' in the respective connection member slots 54''' also provides added exposure of the blade 30''' in the opened position.

Although this embodiment of the shielded knife 10''' illustrates the connection member slot 54''' being formed in one side of the guard 40''', and the connection member being positioned on one side of the blade 30''', the skilled artisan will appreciate that the combination of the connection member slot 56''' and connection member 50''', 52''' may be included on either side of the guard 40'''/blade 30''' or both sides of the guard/blade. The remaining features of this embodiment of the shielded knife 10''' are similar to those of the first embodiment of the shielded knife 10, are labeled with triple prime notation, and require no further discussion herein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A shielded knife, comprising:

a base;

a blade having a lower blade portion, an upper blade portion, a first blade end attached to the base, and a second blade end opposite the first blade end, the lower blade portion being sharpened, and the upper blade portion being dull, wherein the lower blade portion extends from the first blade end to the second blade end, wherein the upper blade portion extends from the first blade end to the second blade end, and wherein the lower blade portion meets the upper blade portion at the second blade end;

a guard pivotally connected to the blade along at least one pivot axis point positioned on the second blade end adjacent the upper portion of the blade, the guard being moveable between an opened position and a closed position, wherein the closed position is defined as the guard engaging the blade to substantially cover the blade, and wherein the opened position is defined as a lower portion of the guard being pivoted away from the sharpened lower end of the blade so that the sharpened lower end of the blade is substantially exposed, the guard pivoting about at least one pivot axis that is substantially orthogonal to the blade, the guard having a first guard end that covers the first blade end near the base while the guard is in the closed position, and the guard having a second guard end that covers the second blade end while the guard is in the closed position;

at least one connection member that operatively connects the second guard end to the second blade end at the at least one pivot axis point, wherein the at least one connection member attaches the guard to the blade through at least one connection member slot formed through the guard, wherein the at least one connection member passes through the at least one connection member slot, and wherein the at least one connection member slot defines a path of rotational direction of the guard as the guard is moved between the opened and the closed positions, the guard traveling in a path defined by the path of the at least one connection member slot as it is moved with respect to the at least one connection member; and a locking member and a locking receiver to receive the locking member to hold the guard in at least one of the opened position and the closed position;

wherein the guard is defined by a top, and a pair of opposing sidewalls extending downwardly from the top so that the guard is a sleeve that is adapted to cover the blade when the guard is in the closed position;

wherein each of the sidewalls includes a lower sidewall portion and an upper sidewall portion, wherein the locking member is positioned substantially adjacent to the upper blade portion on one side of the blade, wherein the locking receiver is positioned on at least one of the upper sidewall portion and the lower sidewall portion of one of the sidewalls of the guard adjacent the side of the blade having the locking member, and wherein the guard is maintained in the opened position when the locking receiver engages the locking member.

2. A shielded knife according to claim 1 wherein the blade includes a first blade side and a second blade side, wherein the pair of opposing sidewalls includes a first sidewall and second sidewall, wherein the at least one connection member slot is a slot on at least one of the first sidewall and the second side wall, and wherein the at least one connection member is a connection member on a respective at least one of the first blade side and the second blade side.

3. A shielded knife, comprising:

a base;

a blade having a lower blade portion, an upper blade portion, a first blade end attached to the base, and a second blade end opposite the first blade end, the lower blade portion being sharpened, and the upper blade portion being dull, wherein the lower blade portion extends from the first blade end to the second blade end, wherein the upper blade portion extends from the first blade end to the second blade end, and wherein the lower blade portion meets the upper blade portion at the second blade end;

a guard pivotally connected to the blade along at least one pivot axis point positioned on the second blade end adjacent the upper portion of the blade, the guard being moveable between an opened position and a closed position, wherein the closed position is defined as the guard engaging the blade to substantially cover the blade, and wherein the opened position is defined as a lower portion of the guard being pivoted away from the sharpened lower end of the blade so that the sharpened lower end of the blade is substantially exposed, the guard pivoting about at least one pivot axis that is substantially orthogonal to the blade, the guard having a first guard end that covers the first blade end near the base while the guard is in the closed position, and the guard having a second guard end that covers the second blade end while the guard is in the closed position wherein the guard is defined by a top, and a pair of opposing sidewalls extending downwardly from the top so that the guard is a sleeve that is adapted to cover the blade when the guard is in the closed position;

at least one connection member that operatively connects the second guard end to the second blade end at the at least one pivot axis point, wherein the at least one connection member attaches the guard to the blade through at least one connection member slot formed through the guard, and wherein the at least one connection member passes through the at least one connection member slot; and a locking member and locking receiver to receive the locking member to hold the guard in at least one of the opened position and the closed position;

wherein each of the pair of opposing sidewalls of the guard includes a lower sidewall portion and an upper sidewall portion, wherein the locking member is positioned substantially adjacent to the upper blade portion on one side of the blade, wherein the locking receiver is positioned on at least one of the upper sidewall and the lower sidewall portion of one of the sidewalls of the guard adjacent the side of the blade having the locking member, and wherein the guard is maintained in the opened position when the locking receiver engages the locking member.

4. A shielded knife according to claim 3 wherein the blade includes a first blade side and a second blade side, wherein the pair of opposing sidewalls includes a first sidewall and second sidewall, wherein the at least one connection member slot is a slot on at least one of the first sidewall and the second side wall, and wherein the at least one connection member is a connection member on a respective at least one of the first blade side and the second blade side.

5. A method of using a shielded knife, the shielded knife comprising a base, a blade having a lower blade portion, an upper blade portion, a first blade end attached to the base, and a second blade end opposite the first blade end, a guard pivotally connected to the blade along at least one pivot axis point positioned on the second blade end adjacent the upper portion of the blade, the guard being defined by a top, and a pair of opposing sidewalls extending downwardly from the top, and at least one connection member that operatively connects the guard to the blade, wherein the at least one connection member attaches the guard to the blade through at least one connection member slot that defines a path of rotational direction of the guard; the method comprising:

moving the guard between a closed position and an opened position, the closed position being defined as the guard engaging the blade to substantially cover the blade, and the opened position being defined as a lower portion of the guard being pivoted away from the lower end of the blade so that the lower end of the blade is substantially exposed; and moving the guard between the closed position and the opened position by pivoting the guard about at least one pivot axis that is substantially orthogonal to the blade, the guard having a first guard end that covers the first blade end near the base while the guard is in the closed position, and the guard having a second guard end that covers the second blade end while the guard is in the closed position;

wherein the shielded knife further includes a locking member and locking receiver;

wherein the locking receiver receives the locking member to hold the guard in at least one of the opened position and the closed position; and wherein each of the pair of opposing sidewalls includes a lower sidewall portion and an upper sidewall portion, wherein the locking member is positioned substantially adjacent to the upper blade portion on one side of the blade, wherein the locking receiver is positioned on at least one of the upper sidewall portion and the lower sidewall portion of one of the sidewalls of the guard adjacent the side of the blade having the locking member, and wherein the guard is maintained in the opened position when the locking receiver engages the lock member.

6. A method according to claim 5 wherein the blade includes a first blade side and a second blade side, wherein the pair of opposing sidewalls includes a first sidewall and second sidewall, wherein the at least one connection member slot is a slot on at least one of the first sidewall and the second side wall, and wherein the at least one connection member is a connection member on a respective at least one of the first blade side and the second blade side.

* * * * *